United States Patent [19]

Matzelle

[11] 4,019,425

[45] Apr. 26, 1977

[54] PISTON PUMP WITH FLOATING PORT PLATE PROVIDING VARIABLE FORCE BALANCE FOR HYDROSTATIC BALANCE

[75] Inventor: Ralph Anthony Matzelle, Brimfield, Ill.

[73] Assignee: Caterpillar Tractor Co., Peoria, Ill.

[22] Filed: Feb. 7, 1975

[21] Appl. No.: 547,905

[52] U.S. Cl. ..... 91/487

[51] Int. Cl.[2] ..... F01B 13/04

[58] Field of Search ..... 91/485, 487, 491

[56] References Cited

UNITED STATES PATENTS

| | | | |
|---|---|---|---|
| 2,977,891 | 4/1961 | Bishop | 91/494 |
| 3,051,093 | 8/1962 | Budzich | 91/485 |
| 3,056,357 | 10/1962 | Bohnhoff | 91/487 |
| 3,136,263 | 6/1964 | Timms | 91/491 |
| 3,752,053 | 8/1973 | Wouters et al. | 91/485 |

FOREIGN PATENTS OR APPLICATIONS

| | | | |
|---|---|---|---|
| 638,604 | 4/1962 | Italy | 91/485 |

*Primary Examiner*—William L. Freeh
*Attorney, Agent, or Firm*—Phillips, Moore, Weissenberger, Lempio & Majestic

[57] ABSTRACT

A hydraulic fluid pressure energy translating device comprising an axial multi-piston pump including an axially and laterally constrained barrel and a floatingly disposed port plate responsive to hydrostatic forces within the pump. The port plate includes hydrostatic pressure balancing means which tend to balance hydrostatic forces acting on the port plate during operation of the pump to maintain an optimum bearing clearance between the port plate and barrel, thereby controlling fluid leakage and maintaining adequate lubrication and support at this interface.

5 Claims, 3 Drawing Figures

PISTON PUMP WITH FLOATING PORT PLATE PROVIDING VARIABLE FORCE BALANCE FOR HYDROSTATIC BALANCE

BACKGROUND OF THE INVENTION

This invention relates to hydraulic fluid pressure energy translating devices. In particular, this invention relates to parallel disposed multi-piston pumps of the type used to convey hydraulic fluids, or the like.

Conventionally, such pumps comprise a rotatable cylinder block or barrel containing a plurality of parallel axially-extending pistons disposed equi-angularly about the central axis of the block. A cam plate is provided at one end of the barrel for engaging bearing shoes provided on each of the pistons and for respectively reciprocating each piston on rotation of the barrel to pump fluid into and out of each piston-containing cylinder. Such pumps are generally equipped with ported plate means for providing a valving action for ingress and egress of fluid into and out of the pump. The port plate further typically provides a bearing area against which the axial thrust of the barrel may be partially absorbed; this bearing area is lubricated with an oil film at the interface of these surfaces which minimizes wear of these elements and prevents seizure.

Although it is highly desirable from the standpoint of control of fluid leakage and the maintenance of adequate lubrication to have port plate and barrel mating surface properly aligned, this alignment is usually difficult to maintain during operation of the pump due to the well-known propensity of the barrel to tilt in a radial direction. This effect is primarily caused by the difference in longitudinal location of the radial components of force acting on the barrel through the pistons during rotation. When the barrel tilts as a result of these forces, the mating surface of the barrel and bearing surface of the port plate are urged out of alignment into an inclined position, resulting in undesirable fluid leakage, and disruption of the lubricating oil film.

Additionally, in conventional axial piston-type pumps, the barrel has a tendency to move axially against the bearing surface of the port plate during operation of the pump in response to axial components of force generated by the pressurized fluid in the cylinders. This net force urging the barrel against the port plate, generally termed the hydraulic clamp force, tends to reduce clearance between the bearing surface of the port plate and the barrel mating surface, and acts in opposition to the provision of an oil film at this interface thereby decreasing lubrication between the barrel and port plate. In the event, for example, of transient over pressure in the cylinders, the hydraulic clamp force may significantly increase, and the concomitant decrease in lubricating oil film at this interface results in wear and tear on these elements, and occasional seizure.

These radial and axial components of force acting upon the barrel are frequently particularly pronounced in pumps of larger size. Increased rotational speeds are required in order to provide the fluid necessary to effectively actuate the associated implements. As the rotational speeds increase, the forces tending to cause axial and radial displacement of the barrel also increase, disrupting the alignment and the clearance between the bearing surface of the port plate and the mating surface of the barrel, or "bearing clearance", thereby resulting in fluid leakage and/or insufficient lubrication at the port plate/barrel interface, as described above.

Although these problems have been recognized in the prior art, and numerous solutions proposed therefor, such as those described in U.S. Pat. Nos. 3,183,846; 2,735,407; 3,267,871 and 3,292,553, including means for laterally stabilizing the cylinder barrel such as described in U.S. Pat. No. 3,267,871 and floating valve means such as described in U.S. Pat. No. 2,649,741, none of these known prior art solutions have proved entirely satisfactory. For example, difficulties have been encountered in resolving the attendant problems of maintaining satisfactory bearing clearance under variable operating conditions in pumps having rigidly positioned barrels, wherein substantial variations in temperature, pressure, rotational speed, vibrations and other factors occur. It is highly desirable that means be provided for simply and effectively compensating for the forces developed within the pump to maintain adequate bearing clearance during pump operation, for controlling fluid leakage which impairs the efficiency of the pump, and for accomodating an adequate lubricating oil film between the port plate/barrel interface which prevents excessive wear, or in extreme cases, seizure of these elements.

SUMMARY AND OBJECTIVES OF THE INVENTION

Accordingly, the invention comprises an axial multi-piston type pump for hydraulic pumps or motors including an axially and laterally constrained barrel, and a floatingly disposed port plate responsive to hydrostatic forces within the pump. Optimum bearing clearance is maintained between the bearing surface of the port plate and the mating surface of the barrel during operation of the pump by an appropriate balance of these hydrostatic forces, thereby controlling fluid leakage and maintaining satisfactory lubricant levels at the port plate/barrel interface.

Balancing means for obtaining an appropriate balance of hydrostatic forces acting against the port plate to maintain optimum bearing clearance include a plurality of hydrostatic pads comprising fluid-containing recess means within the port plate at the plate/barrel interface, and a plurality of flow control means for regulating fluid flow to these recess means. The resulting hydrostatic forces exerted on the port plate, balance other hydrostatic forces present also acting on the port plate and provide an optimum bearing clearance for satisfactory lubrication and leakage control.

It is therefore an object of this invention to provide an axial multi-piston type pump having means for maintaining an optimum bearing clearance during pump operation.

It is yet another object of this invention to provide an axial multi-piston type pump having a constrained barrel and means for maintaining an optimum bearing clearance during pump operation.

DETAILED DESCRIPTION OF THE DRAWINGS

Figure 1:
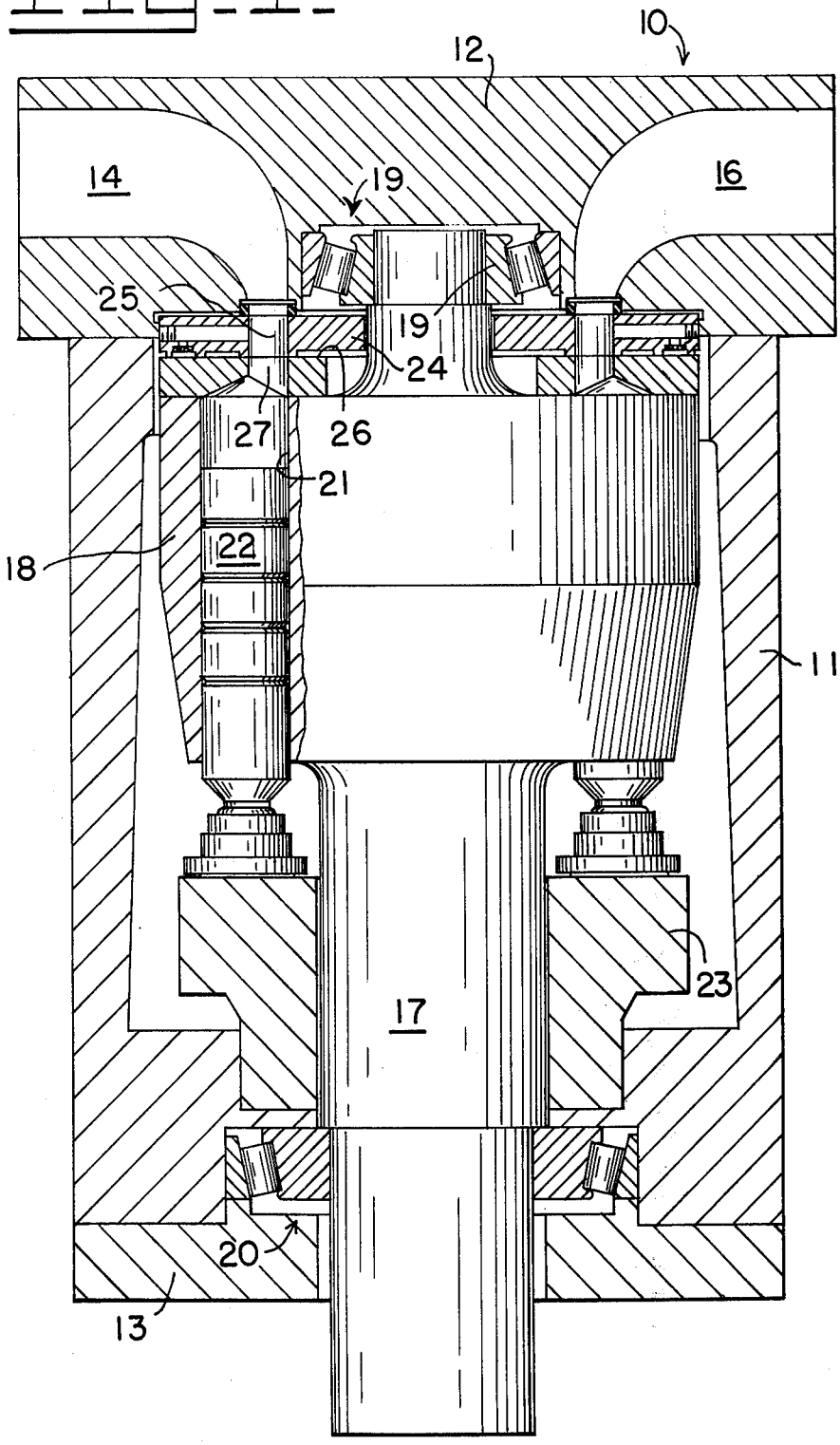
FIG. 1 is a cross-sectional view of an axial multi-piston type pump, including the barrel constraining means, floating port plate, and hydrostatic pressure balancing means of this invention.

With particular reference to FIG. 1, a hydraulic fluid pressure energy translating device comprising an axial multi-piston pump is illustrated generally at 10. Pump 10 has a housing 11 provided with a port cap 12 mounted on one end thereof, and a base 13 mounted on the end thereof. The port cap 12 has disposed therein fluid discharge port 14 and a fluid supply port 16 leading into the pump 10 for discharge and introduction of fluid, respectively. A shaft 17 is generally coaxially disposed within the housing 11, and is drivingly connected to motor means (not shown) for rotation within said housing. A generally cylindrical rotatable barrel or cylinder block 18 is coaxially rigidly disposed about shaft 17 and operatively engaged therewith so that rotation of the shaft 17 is accompanied by rotation of barrel 18. In this embodiment, the barrel 18 and shaft 17 are constrained against axial and lateral or tipping displacement by bearing assembly means 19 radially disposed between the shaft 17 and port cap 12, and similar bearing assembly means 20 radially disposed between the shaft 17 and the lower portion of the housing 11.

A plurality of cylindrical bores 21 are disposed within the barrel 18 annularly of the shaft 17 and parallel to the longitudinal axis of the barrel. A plurality of pistons 22 are slideably engaged within bores 21 and operatively connected by conventional means (not shown) at the head portions thereof to a cam plate 23 coaxially disposed about shaft 17 and annularly spaced therefrom.

A non-rotatable port plate means 24 is floatingly disposed between port cap 12 and mating surface 26 at the upper portion of the barrel 18, concentrically of the shaft 17. Plate means 24 is provided with a plurality of ports 25 in registry with ports 14 and 16 and communicable with passages 27 of bores 21 so that fluid may be discharged from the supplied to bores 21 during operation of the pump.

Figure 2:
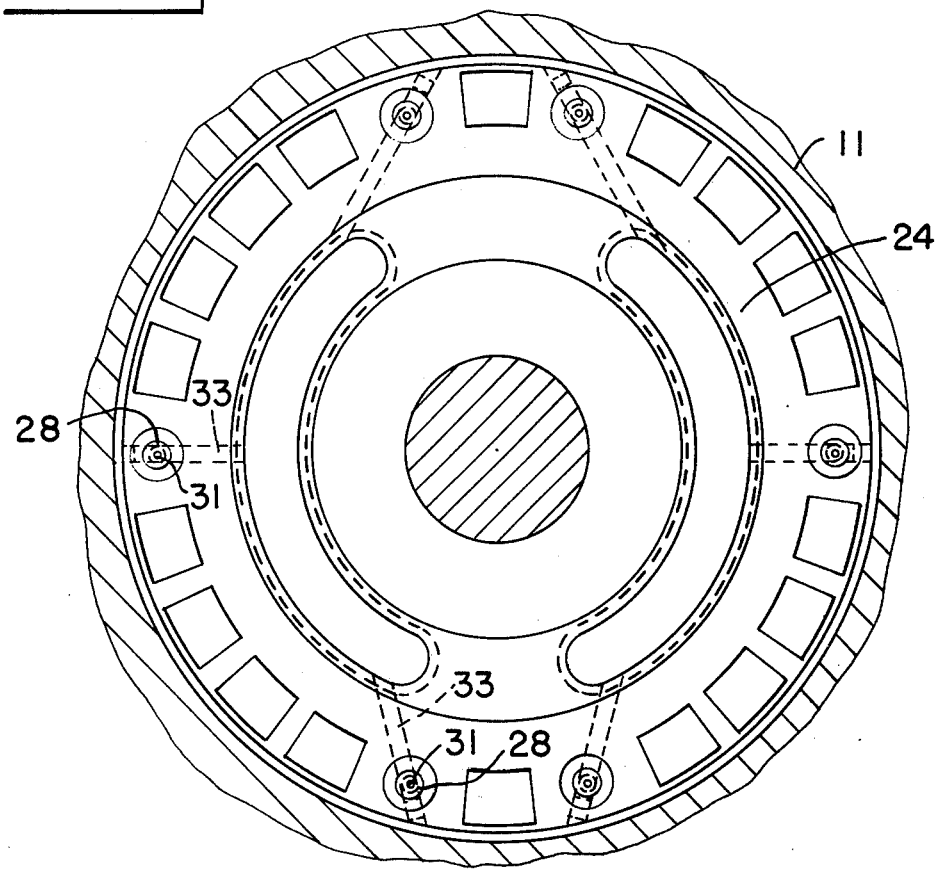
FIG. 2 is an elevation of the bearing surface of the floating port plate means of this invention.
Figure 3:
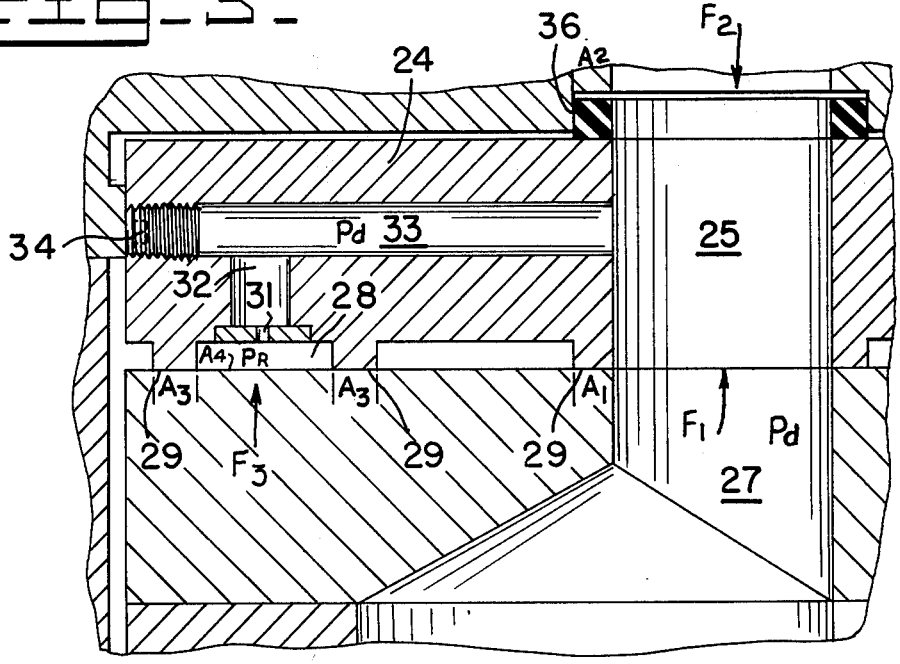
FIG. 3 is a partial cross-sectional elevation of the pump of FIG. 1 including in detail the port plate and hydrostatic pressure balancing means of this invention.

With particular reference to FIGS. 2 and 3, the hydrostatic pressure balancing means of this invention is generally illustrated, including a hyddrostatic pad area comprising recess means 28 in bearing surface 29 of port plate 24, flow control means such as an orifice 31 disposed between the recess means 28 and a first port plate passage 32, and a second port plate passage 33 communicating between first passage 32 and an arcuate port 25. Arcuate port 25 is thus in communication with recess means 28 via first and second passages 32 and 33 and orifice 31. Passage 33 may be formed by drilling from the outer circumference of port plate 24, and the bore plugged to the desired depth by a plug 34.

In accordance with the invention, the desired bearing clearance between mating surface 26 of the barrel 18 and the bearing surface 29 of the port plate 24 for optimum lubrication and fluid leakage control during pump operation is obtained in the following manner:

Referring particularly to FIG. 3, three hydrostatic forces, $F_1$, $F_2$ and $F_3$ act on the port plate 24 during pump operation. The Force $F_1$ is developed by fluid pressure acting on a sill area $A_1$, the force $F_2$ is developed by fluid pressure acting on the area $A_2$ of a seal 36 disposed between the port plate 24 and port cap 12 to prevent fluid leakage at this junction, and the force $F_3$ is developed by fluid pressure acting on the sill areas $A_3$ and $A_4$. When force $F_2$ is equal to force $F_1$ plus $F_3$, the forces are in balance, and the port plate 24 will be correctly positioned to provide an optimum bearing clearance. Simplified, these forces with respect to the components indicated in FIG. 3 may be defined as follows:

$$F_1 = (P_d(A_1)/2)\ F_2 = (P_d(A_2)/2)$$
$$F_3 = (P_R(A_3)/2) = P_R A_4$$

A further generally insignificant force F resulting from various effects, such as hydrodynamic effect, which may be defined as F=PA may also be included so that the hydrostatic forces are balanced when:

$$F_2 = F_1 + F_3 + F$$

The balance occurs as follows:

For a given discharge pressure $P_d$, $F_1$ will equal the pressure on sill area $A_1$, times the sill area $A_1$. This pressure varies from $P_d$ to "0", or atmospheric across the sill. Force $F_2$ will equal the pressure on sill area $A_2$ times the area $A_2$ of the seal 36, and will always be greater than $F_1$. The addition of one or more hydrostatic pad areas is required, with the number dependent on the area required to produce the force necessary to balance the opposing forces and the overturning moments. When the downward forces ($F_2$) are greater than the upward forces ($F_1 + F_3$), port plate 24 is clamped toward barrel 18, thereby reducing the flow across sill area $A_3$, passages 32 and 33 and orifice 31. Therefore there will be a smaller pressure drop $\Delta P$ across orifice 31 so that pressure $P_R$ will increase to a magnitude closer to, but not greater than $P_d$. This will cause the total of upward forces to become greater than the total of the downward forces, and the port plate 24 will move upwardly, away from the barrel 18. In so doing, a greater flow is developed across orifice 31, thereby developing a larger $\Delta P$ across it. Since $P_R$ is equal to $P_d$ minus $\Delta P$ across the flow control means, $R_R$ will decrease and $F_3$ will decrease. Movement of port plate 24 away from the barrel 18 will continue until the forces and moments are balanced, that is, when the upper forces equal the downward forces. At that instant a proper bearing clearance will be obtained between plate 24 and mating surface 26 of the barrel 18. Thus when factors such as temperature, rotational speed and pressure affect fluid flow through the flow control means, the port plate 24 will respond by shifting until a balance of forces against the plate are obtained.

It is important that the flow control means be adapted so that the resultant balance hydrostatic forces provide the desired bearing clearance for the expected operating conditions. For example, variations in the diameter of the orifice 31 will affect the fluid flow therethrough, and hence the balance of hrdrostatic forces acting on the port plate 24, with resulting variations in bearing clearance.

From the above description, it will be seen that the bearing face of the port plate 24 is defined by a plurality of narrow band sills 29 defined by axially extending walls and surrounding respectively the ports 25 and the hydrostatic pads 28. Hydrostatic forces acting on these surfaces support the port plate 24 with respect to the barrel head. These hydrostatic forces are opposed or balanced by hydrostatic forces acting on area $A_2$, which is the upper face of seal 36 which defines narrow band sill means, which surround the respective ports 25. This seal 36 is disposed in an annular groove, or more particularly, a groove surrounding the port formed in the head thereof 12 surrounding each of the passages 14 and 16. The seal 36 is so mounted within this slot that pressure within the port 25 is communicated to the upper surface thereof for biasing the seal into engagement with the upper surface of the port plate 24.

What is claimed is:

1. A port plate for a hydraulic fluid pressure energy translating device floatingly disposed between a barrel and a port cap of said device and having a plurality of ports for communicating therebetween, said port plate having hydrostatic presure balancing means for balancing hydrostatic pressures of both sides thereof within the device to obtain an optimum bearing clearance between said port plate and said barrel, said balancing means includes a plurality of fluid-containing recess means within a bearing surface of said port plate directed toward said barrel and flow control means including a fluid-flow passageway communicating between a port of said port plate and said recess means, and for regulating flow into said recess means, fluid restricting means including an orifice between said passageway and said recess means for regulating pressure within said recess means, narrow band sill means surrounding each of said ports between said port plate and said port cap and responsive to fluid pressure within said ports for acting in opposition to pressure in said recess means for balancing hydrostatic pressure acting on said port plate, said narrow band sill means being defined by a seal disposed between said port plate and said cap and having one surface in contact with said port plate and an opposing second surface defining said sill means in open communication with fluid in said port.

2. The invention of claim 1 wherein said bearing surface includes a plurality annular wall means extending from said port plate defining said recess means, and an annular surface surrounding each recess means, and wall means extending from said port plate surrounding said ports and defining narrow band bearing surfaces surrounding each of said ports.

3. In a hydraulic fluid pressure energy translating device of the type having a housing provided with a port cap having inlet and outlet ports formed therein at one end thereof and a base at the other end thereof; a rotatable barrel coaxially mounted on a shaft for rotation therewith, said barrel containing a plurality of cylindrical bores annularly disposed within said barrel parallel to the longitudinal axis thereof; a plurality of reciprocable pistons slidably engaged within said bores and bearing against an inclined swash plate, said pistons reciprocating within said bores as said barrel is rotated relative to said swash plate; the improvement comprising barrel constraining means for constraining the barrel against axial and lateral displacement during pump operation, a port plate having ports therein communicating with said inlet and outlet ports floatingly disposed between said barrel and said port cap, hydrostatic pressure balancing means for balancing hydrostatic pressure on both sides of said port plate including a plurality of fluid containing recess means for providing a hydrostatic pad between said port plate and said barrel, to obtain an optimum bearing clearance between said port plate and said barrel, flow control means including a fluid-flow passageway communicating between a port of said port plate and said recess means for fluid flow therebetween, said flow control means further including fluid restricting means between said passageway and said recess means for regulating pressure within said recess means, narrow band sill means surrounding said ports between said port plate and said port cap and responsive to fluid pressure within said ports for acting in opposition to pressure in said recess means for balancing hydrostatic pressure acting on said port plate, said narrow band sill means being defined by a seal disposed between said port plate and said cap and having one surface in contact with said port plate and an opposing second surface defining said sill means in open communication with fluid in said port.

4. The invention of claim 3, wherein said barrel constraining means includes a first bearing assembly means radially disposed between said shaft and said port cap, and a second bearing assembly means radially disposed between said shaft and a lower portion of said housing.

5. The invention of claim 3 wherein said bearing surface includes a plurality annular wall means extending from said port plate defining said recess means, and an annular surface surrounding each recess means, and wall means extending from said port plate surrounding said ports and defining narrow band bearing surfaces surrounding each of said ports.

* * * * *